US007665449B2

(12) United States Patent
Kuji et al.

(10) Patent No.: US 7,665,449 B2
(45) Date of Patent: Feb. 23, 2010

(54) V-TYPE ENGINE

(75) Inventors: Yasuhiro Kuji, Kako-gun (JP); Akinobu Wakabayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 164 days.

(21) Appl. No.: 12/007,784

(22) Filed: Jan. 15, 2008

(65) Prior Publication Data

US 2008/0168765 A1 Jul. 17, 2008

(30) Foreign Application Priority Data

Jan. 15, 2007 (JP) ..... P2007-005525

(51) Int. Cl.
*F02B 23/10* (2006.01)
*F02M 23/00* (2006.01)
*F01N 3/22* (2006.01)

(52) U.S. Cl. ..... 123/585; 123/54.4; 60/305

(58) Field of Classification Search ..... 123/308, 123/54.4–54.7, 585–588; 60/305
See application file for complete search history.

(56) References Cited

U.S. PATENT DOCUMENTS 6,234,124 B1 * 5/2001 Tsukui et al. ..... 123/90.15
6,311,483 B1 * 11/2001 Hori et al. ..... 60/293
6,382,197 B1 * 5/2002 Matsumoto ..... 123/585
6,439,185 B2 * 8/2002 Tosaka et al. ..... 123/90.27
7,131,262 B2 * 11/2006 Sealy et al. ..... 60/277
2005/0193725 A1 * 9/2005 Kaneshiro ..... 60/305
2006/0065255 A1 * 3/2006 Hirayama et al. ..... 123/585
2006/0157004 A1 * 7/2006 Gunji et al. ..... 123/54.4
2008/0308082 A1 * 12/2008 Kisaichi et al. ..... 123/585

FOREIGN PATENT DOCUMENTS

JP 2003-74319 3/2003

* cited by examiner

*Primary Examiner*—Erick Solis
(74) *Attorney, Agent, or Firm*—Wenderoth, Lind & Ponack, L.L.P.

(57) ABSTRACT

In a V-type engine, throttle devices are disposed between front and rear cylinders disposed in a V-shape, and an air cleaner is disposed above the throttle device. A secondary air pipe is connected to a secondary air entrance portion formed in an outer peripheral wall surface of each of the cylinders. A secondary air on-off valve is disposed below the throttle device, and the secondary air on-off valve is provided so as to be substantially accommodated in a V-bank space between the cylinders. A secondary air inlet of the secondary air on-off valve is connected to the air cleaner by the secondary air source pipe extended upward, a secondary air pipe for each cylinder is connected to the secondary air outlet for each cylinder, and the secondary air outlet for each cylinder is formed in the secondary air on-off valve.

10 Claims, 9 Drawing Sheets

V-TYPE ENGINE

BACKGROUND OF THE INVENTION

1. Field of the Invention

The present invention relates to a V-type engine including a secondary air supply apparatus.

2. Description of the Related Art

Usually, in a V-type engine including a secondary air supply apparatus, secondary air is taken in from an air cleaner, and the secondary air is supplied to exhaust gas passages of cylinder heads of the front and rear cylinders through a secondary air supply pipe or the like. The secondary air is supplied to the exhaust gas passage to re-burn the unburned gas, which promotes purification of an exhaust gas. Depending on a running state, sometimes back fire is caused by excessive supply of the secondary air. Therefore, in order to cut the supply of the secondary air if needed, a secondary air on-off valve, i.e., a so-called air-cut valve is disposed in a secondary air supply passage.

FIGS. 9 and 10 show arrangement examples of the secondary air pipe, the secondary air on-off valve, and the like in a conventional V-type engine. In FIGS. 9 and 10, the same component is designated by the same numeral.

In the V-type engine shown in FIG. 9, front and rear cylinders 101 and 102 are disposed in a V-shape, exhaust gas outlets 115 and 116 are formed in a front lower wall surface of a cylinder head of the front cylinder 101 and a rear lower wall surface of a cylinder head of the rear cylinder 102 respectively. An air cleaner 103 is disposed at the back of a V-bank space, and the secondary air on-off valve 105 is provided above the air cleaner 103. A secondary air source pipe 110 is connected to a secondary air inlet 105*a* formed at a rear end of the secondary air on-off valve 105, and the secondary air source pipe 110 is extended downward and connected to the air cleaner 103. A secondary air pipe 111 for the front cylinder 101 is connected to a secondary air outlet 105*b* for the front cylinder 101, formed at a front end of the secondary air on-off valve 105, and the secondary air pipe 111 for the front cylinder 101 is extended forward along an upper end face of the front cylinder 101 and connected to the exhaust gas passages of the front cylinder 101 through a lead valve 113 disposed in a front upper end portion of the front cylinder 101. On the other hand, secondary air pipe 112 for the rear cylinder 102 is connected to a secondary air outlet 105*c* for the rear cylinder, formed at a rear end of the secondary air on-off valve 105, and the secondary air pipe 112 for the rear cylinder 102 is extended backward along an upper end face of the rear cylinder 102 and connected to the exhaust gas passages of the rear cylinder 102 through a lead valve 114 disposed in a front upper end portion of the rear cylinder 102.

In the V-type engine shown in FIG. 10, similarly to the V-type engine of FIG. 9, the air cleaner 103 is disposed in the side portion of the V-bank space formed between the front and rear cylinders 101 and 102. On the other hand, the secondary air on-off valve 105 is disposed in the upper end face of the front cylinder 101. The secondary air source pipe 110 connected to the secondary air inlet 105*a* at the rear end of the secondary air on-off valve 105 is extended backward and bent downward, and the secondary air source pipe 110 is connected to the air cleaner 103. The secondary air pipe 111 for the front cylinder 101, connected to the secondary air outlet 105*b* at the front end of the secondary air on-off valve 105, is extended forward along the upper end face of the front cylinder 101 and connected to the exhaust gas passage of the front cylinder 101 through the lead valve 113. On the other hand, the secondary air pipe 112 for the rear cylinder 102, connected to the secondary air outlet 105*c* at the rear end of the secondary air on-off valve 105, passes above the V-bank space and the air cleaner 24, and the secondary air pipe 112 is extended backward along the upper end face of the rear cylinder 102 and connected to the exhaust gas passage of the rear cylinder 102 through the lead valve 114. For example, Japanese Patent Publication Laid-Open No. 2003-74319 discloses a conventional technique.

In the conventional structure shown in FIGS. 9 and 10, the secondary air on-off valve 105 is disposed above the air cleaner 103 or at the upper end of the cylinder 101, the lead valves 113 and 114 for taking the secondary air are disposed in the front end portion of the front cylinder 101 and the rear end portion of the rear cylinder 102, and the secondary air pipes 111 and 112 are provided in the upper end faces of the cylinders 101 and 102. However, in the conventional structure, unfortunately a total height of the engine is increased, a whole piping length of the secondary air pipes 111 and 112 is lengthened, and a large external piping space is required to upsize a periphery of the engine. Additionally, a fore-and-aft length is also increased in the upper portion of the engine because the lead valves 113 and 114 are disposed in the front end portion of the front cylinder 101 and the rear end portion of the rear cylinder 102.

SUMMARY OF THE INVENTION

The present invention addresses the above described condition, and an object of the present invention is to provide a V-type engine provided with a secondary air supply device, in which a piping structure outside the engine, a height of the engine and a length of the engine in the fore-and-aft direction can be compact.

In accordance with a first aspect of the invention, a V-type engine includes front and rear cylinders disposed in a V-shape, a throttle device disposed between the front and rear cylinders, an air cleaner disposed above the throttle device, and a secondary air supply apparatus. The secondary air supply apparatus comprises, a secondary air pipe connected to a secondary air entrance portion provided on an outer peripheral wall surface surrounding each cylinder bore, a secondary air on-off valve disposed below the throttle device, the secondary air on-off valve being provided so as to be substantially accommodated in a V-bank space between the cylinders, and a secondary air source pipe extended upward from a secondary air inlet of the secondary air on-off valve and connected to the air cleaner, and a secondary air outlet for each cylinder is connected to the secondary air pipe for each cylinder, the secondary air outlet for each cylinder being formed in the secondary air on-off valve.

With this configuration, the total height of the engine can be kept at a lower level, a compact external piping for secondary air including the secondary air source pipe, the secondary air pipe, and the secondary air on-off valve can be disposed around the engine main body, and the periphery of the whole engine can be downsized.

Preferably the secondary air entrance portion may be provided in a sidewall surface which is substantially orthogonal to a wall surface on a front side or a rear side in the outer peripheral wall surface of each cylinder bores.

With this configuration, each secondary air pipe can be shortened because a distance between the secondary air on-off valve disposed in the V-bank space and each secondary air entrance portion is shortened. Therefore, the compact piping for secondary air can be achieved to smoothly circulate the secondary air.

Preferably a lead valve for secondary air may be provided in the secondary air entrance portion of each cylinder.

With this configuration, the length can be shortened in the fore-and-aft direction of the engine.

Preferably the secondary air on-off valve may be substantially positioned in a region of a clean side space of the air cleaner when viewed from above.

With this configuration, the secondary air outlet portion of the air cleaner 24 and the secondary air inlet of the secondary air on-off valve can be connected by the most direct way using the short secondary air source pipe.

Preferably the secondary air source pipe may be linearly extended in a substantially perpendicular direction.

With this configuration, the secondary air source pipe can be shortened.

Preferably the secondary air on-off valve may be fixed to a bottom portion of the V-bank space.

With this configuration, a mounting structure of the secondary air on-off valve is facilitated.

Preferably a part of the secondary air pipe may be extended near the bottom portion of the V-bank space in an substantially orthogonal direction to a sidewall face in the outer peripheral wall surface of the cylinder bore, and the secondary air on-off valve is fixed to the extended part.

With this configuration, because the extended portions of the secondary air pipe can be utilized as the mounting member of the secondary air on-off valve, it is not necessary to separately provide the mounting member.

Preferably the secondary air on-off valve may be disposed on a straight line connecting the secondary air inlets of the secondary air entrance portions of the cylinders when viewed from the side of the V-type engine.

With this configuration, the secondary air supply pipe can substantially linearly be extended in the fore-and aft direction, and the conduit line for secondary air can be shorted.

Preferably the secondary air inlets of the secondary air entrance portions of the cylinders may be disposed on a virtual plane including the secondary air on-off valve.

With this configuration, the secondary air supply pipe can substantially linearly be extended in the fore-and aft direction, and the conduit line for secondary air can be shorted.

In accordance with a second aspect of the invention, a V-type engine includes front and rear cylinders disposed in a V-shape, an air cleaner arranged above the cylinders, and a secondary air supply apparatus, wherein the secondary air supply apparatus includes a secondary air pipe connected to a secondary air entrance portion provided in an outer peripheral wall surface surrounding each cylinder bore, a secondary air on-off valve disposed below top surfaces of the cylinders, the secondary air on-off valve being provided so as to be substantially accommodated in a V-bank space between the cylinders; and a secondary air source pipe extended from a secondary air inlet of the secondary air on-off valve and connected to the air cleaner, and a secondary air outlet for each cylinder is connected to the secondary air pipe for each cylinder, the secondary air outlet for each cylinder being formed in the secondary air on-off valve.

With this configuration, similarly to the first aspect of the invention, the total height of the engine can be kept at a lower level, the compact external piping for secondary air including the secondary air source pipe, the secondary air pipe, and the secondary air on-off valve can be disposed around the engine main body, and the periphery of the whole engine can be downsized.

BRIEF DESCRIPTION OF THE DRAWINGS

The above and other objects, features and advantages of the present invention will be become more apparent from the following description taken in connection with the accompanying drawings, in which.

DETAILED DESCRIPTION OF THE PREFERRED EMBODIMENT

Figure 1:
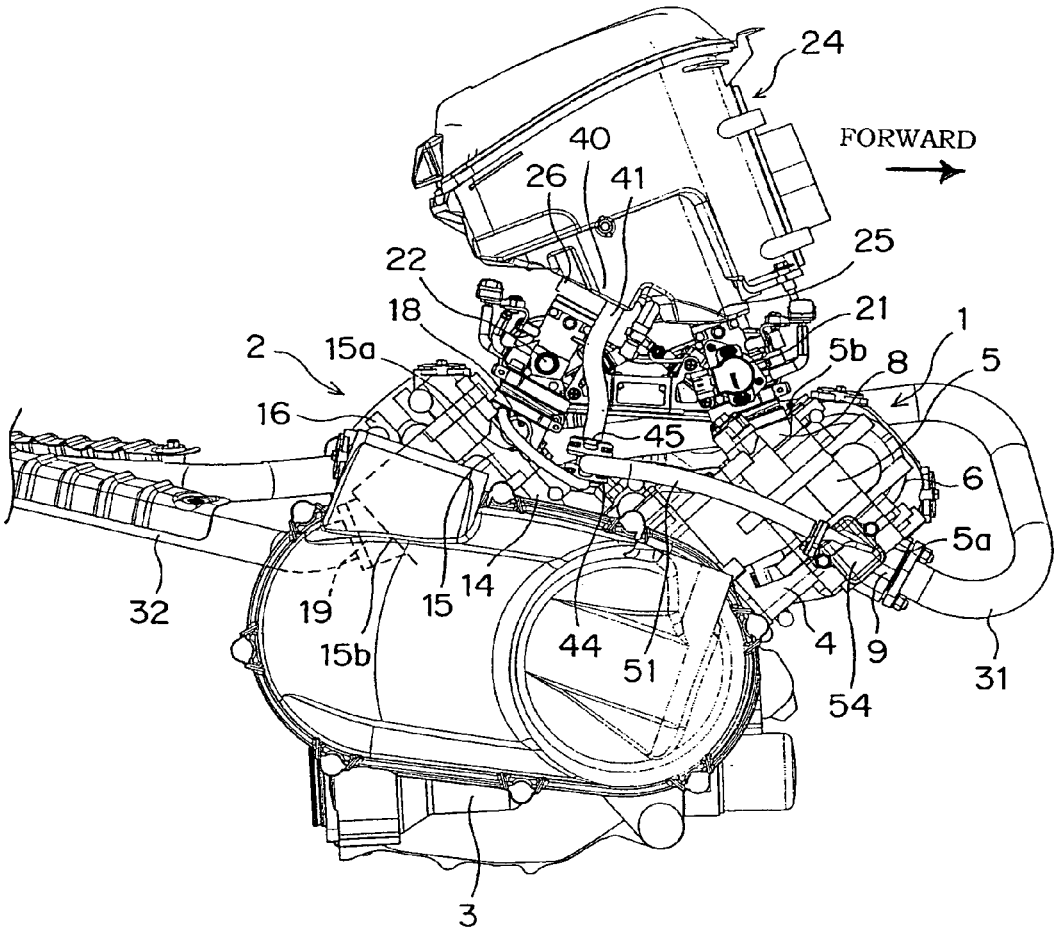
FIG. 1 is a right side view showing a V-2 cylinder engine including a secondary air supply apparatus according to an embodiment of the present invention.
Figure 2:
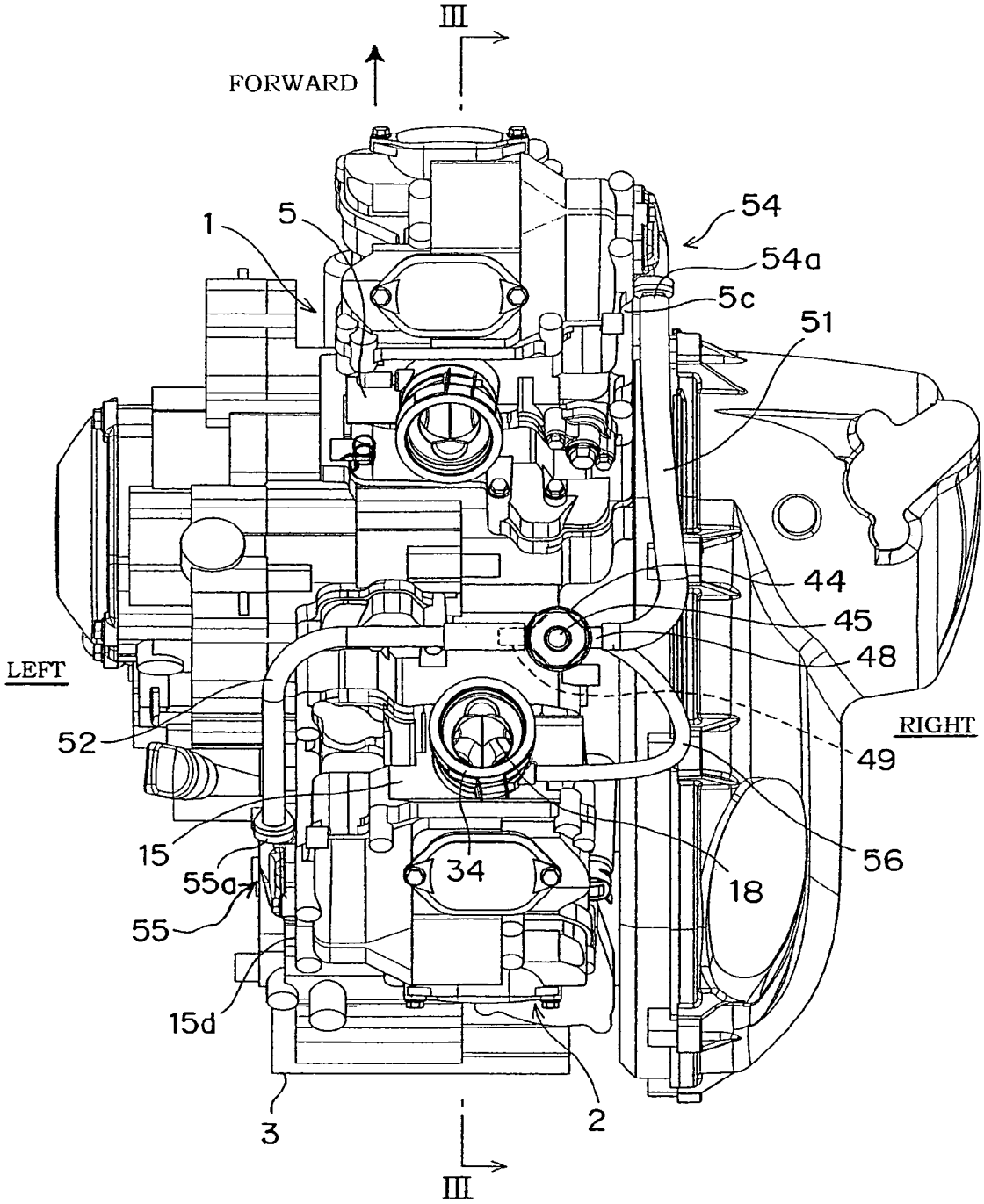
FIG. 2 is a plan view showing the V-2 cylinder engine of FIG. 1.
Figure 3:
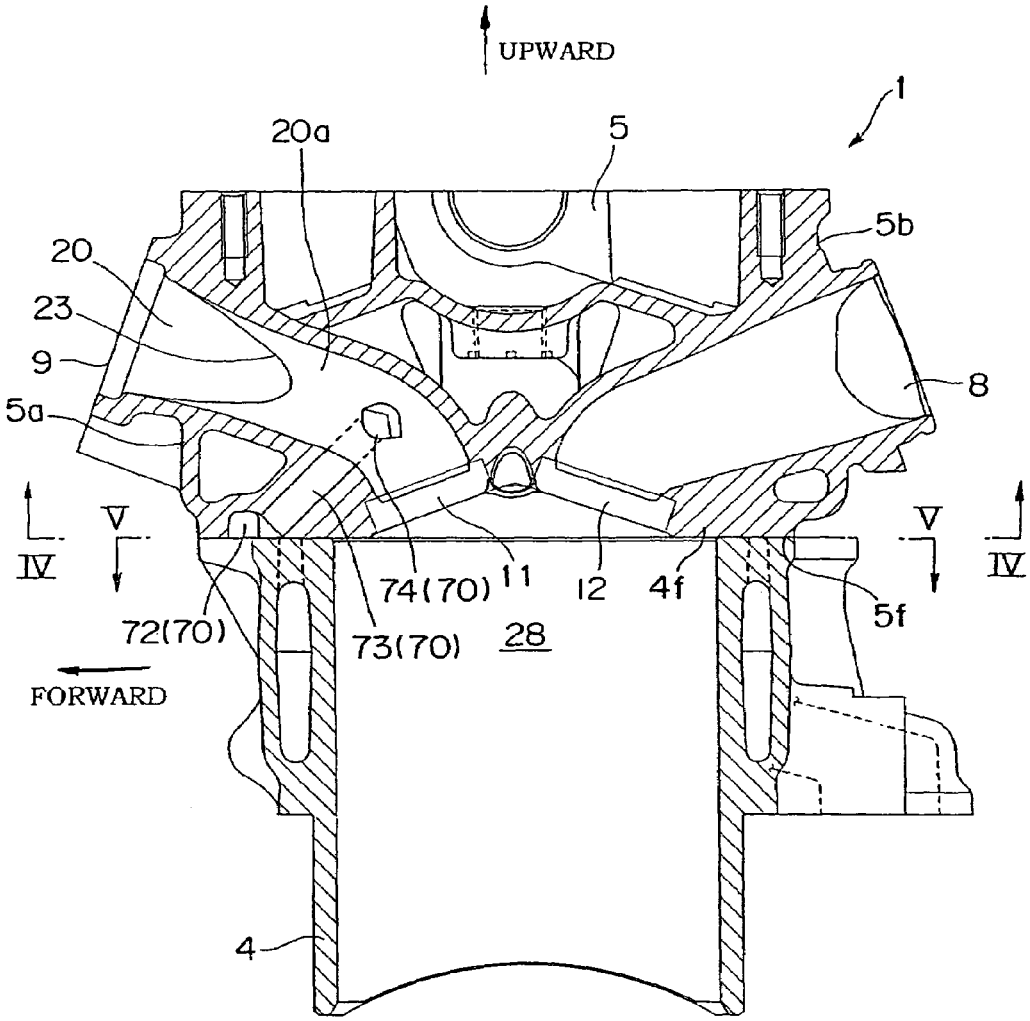
FIG. 3 shows a sectional view taken along a line III-III of FIG. 2 of a front cylinder in the V-2 cylinder engine of FIG. 1.
Figure 4:
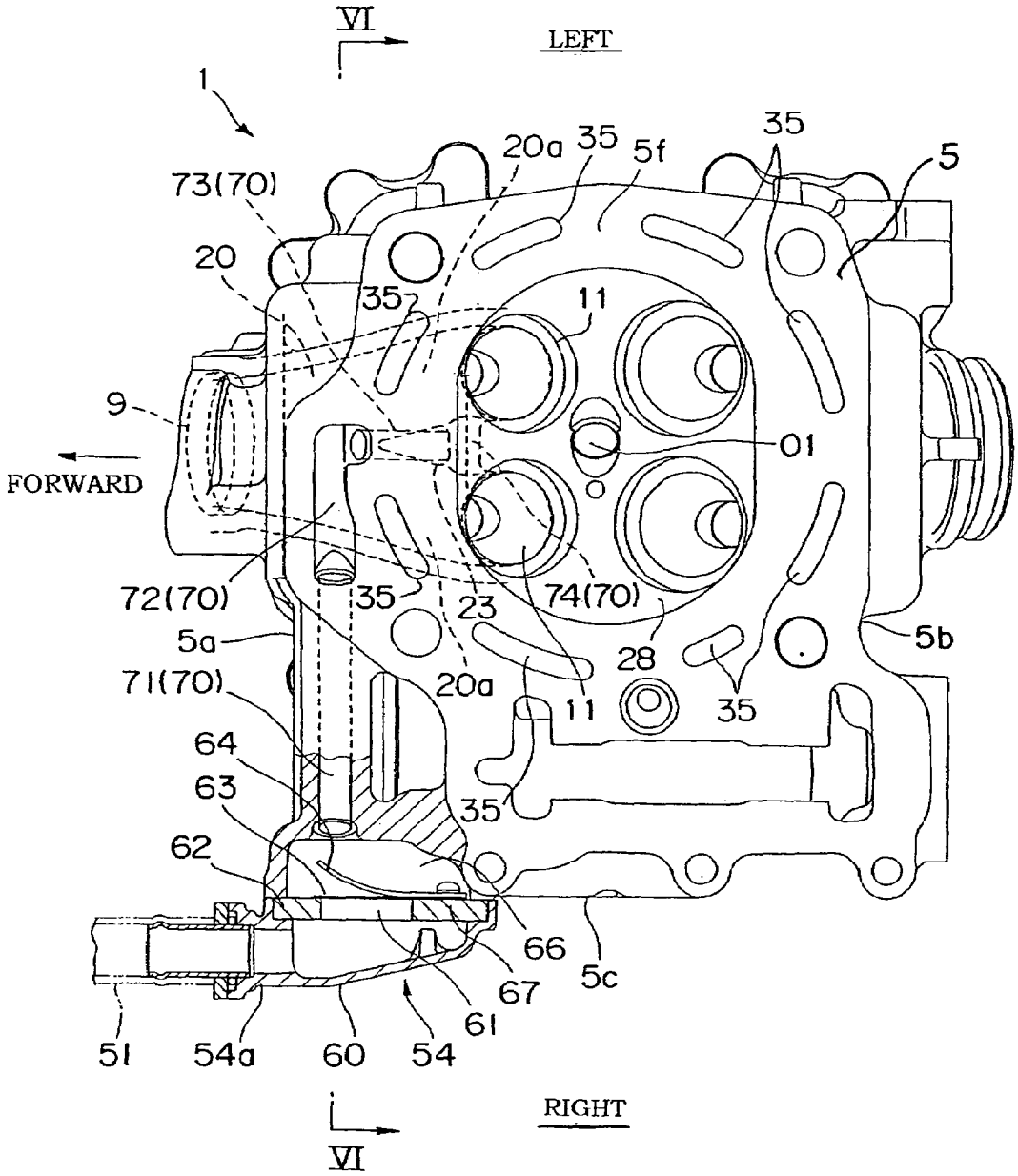
FIG. 4 shows a partially cut out sectional view (bottom view of a cylinder head of the front cylinder) taken along a line IV-IV of FIG. 3.
Figure 5:
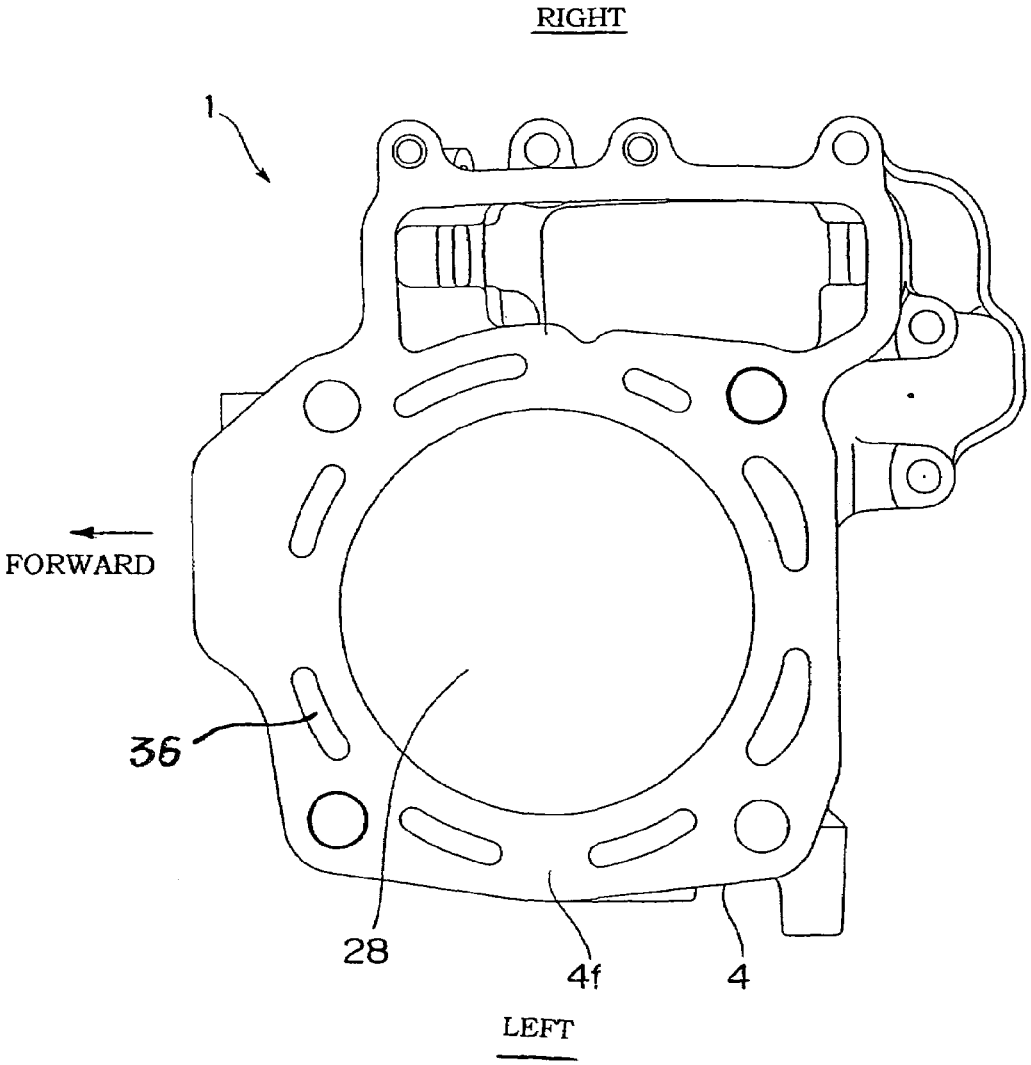
FIG. 5 shows a sectional view (top view of a cylinder head of the front cylinder) taken along a line V-V of FIG. 3.
Figure 6:
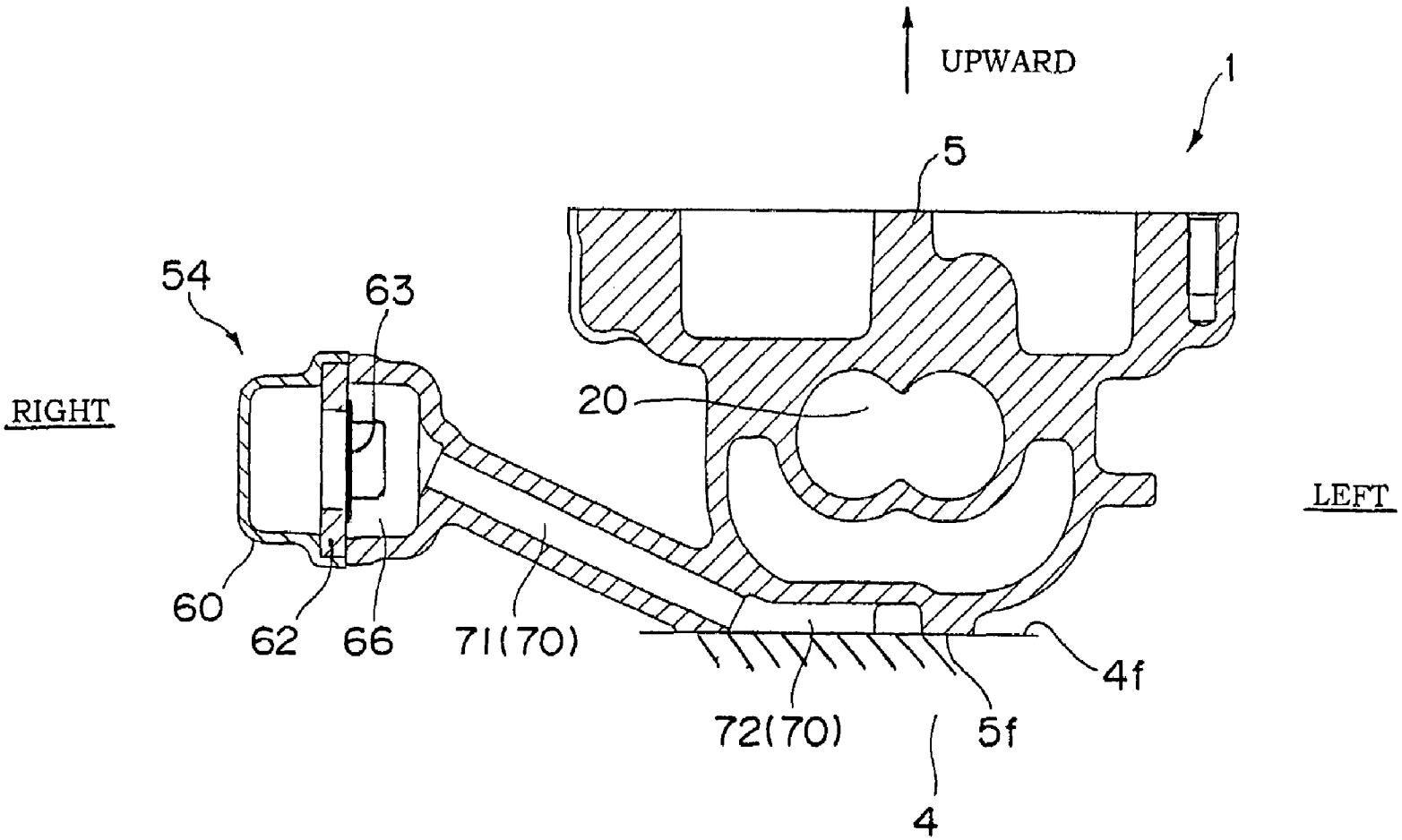
FIG. 6 shows a sectional view taken along a line VI-VI of FIG. 4.
Figure 7:
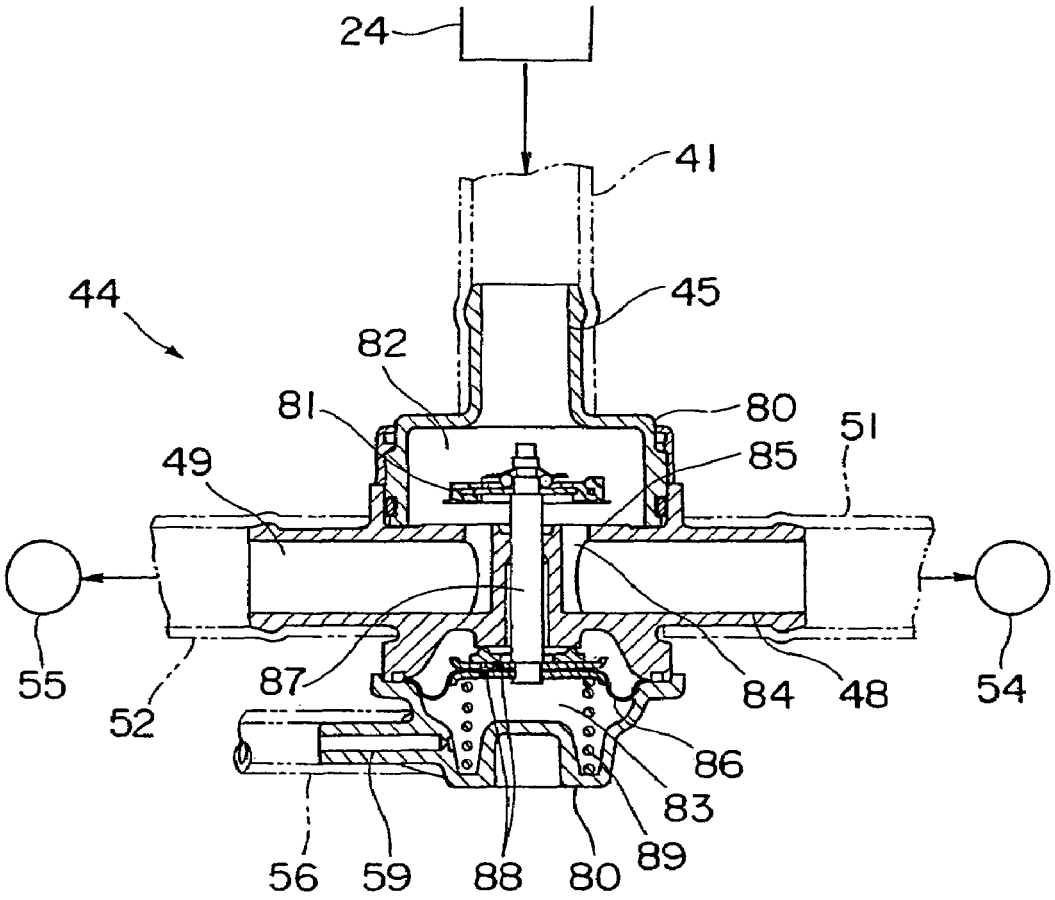
FIG. 7 shows an enlarged longitudinal sectional view of a secondary air on-off valve of the engine of FIG. 4.
Figure 8:
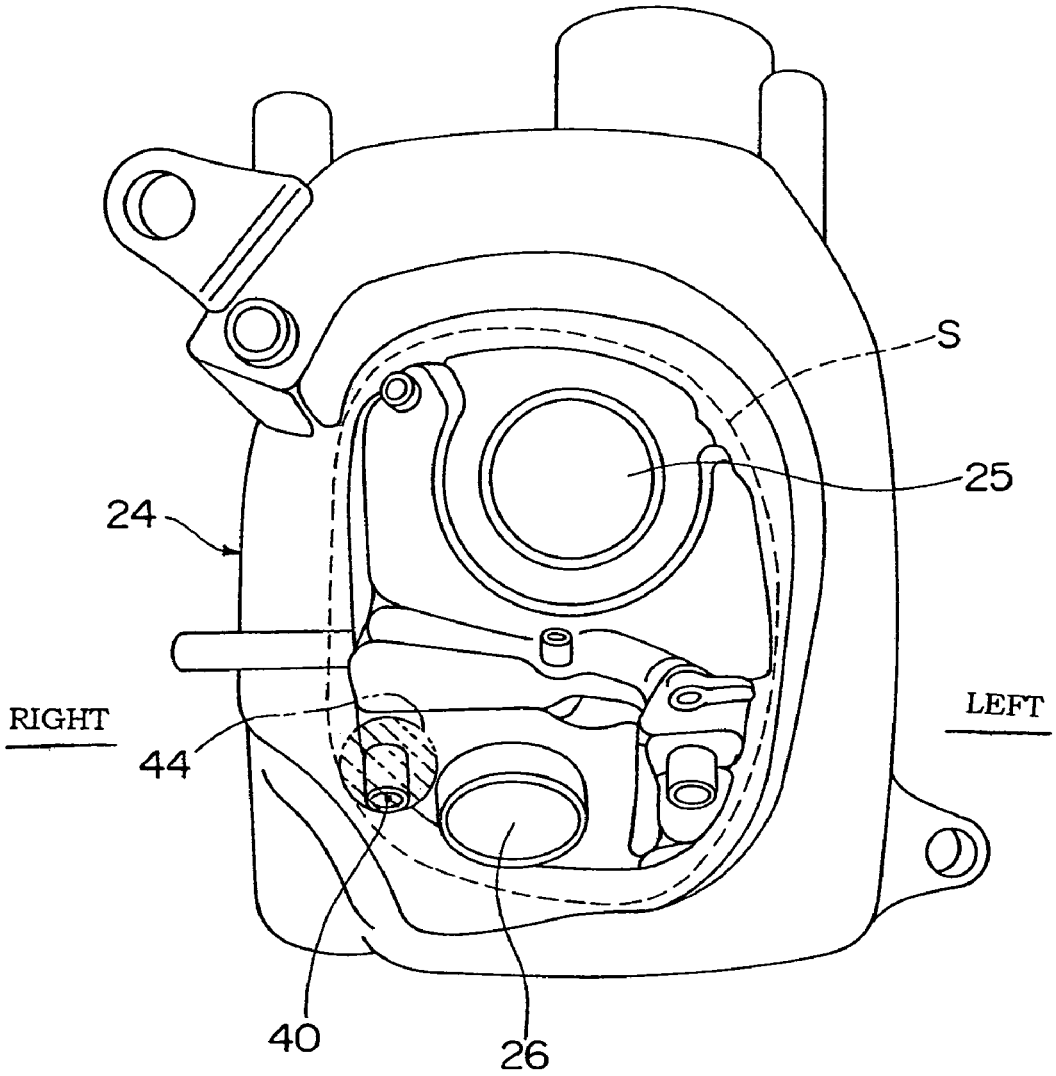
FIG. 8 is a bottom view of an air cleaner.
Figure 9:
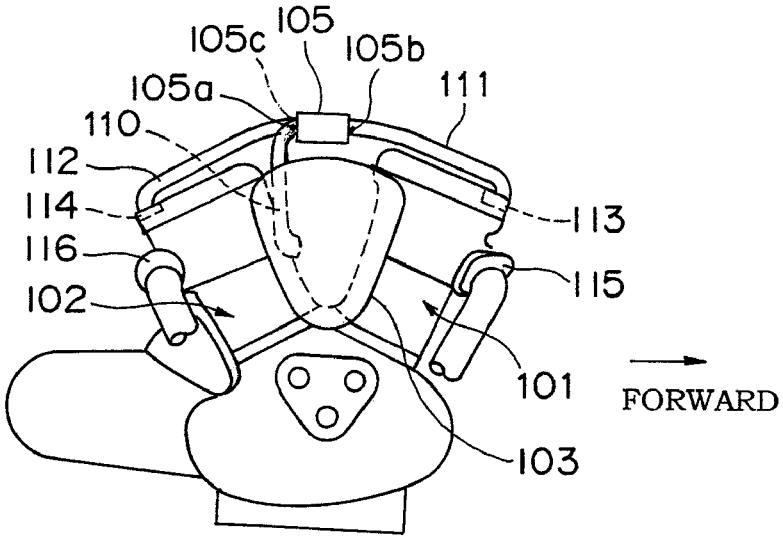
Fig. 9 PRIOR ART
FIG. 9 is a right side view showing an engine of a conventional example.
Figure 10:
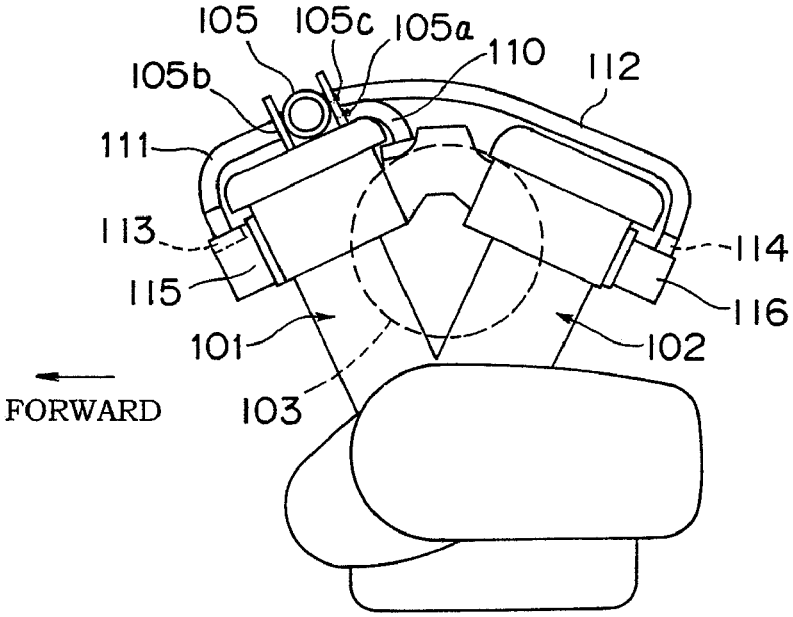
Fig 10 PRIOR ART
FIG. 10 is a left side view showing an engine of another conventional example.

FIGS. 1 to 8 show a V-2 cylinder engine for vehicle according to an embodiment of the present invention, and the V-2 cylinder engine is mainly mounted on a four-wheeled all terrain vehicle (A.T.V.). FIG. 1 is a right side view showing the V-2 cylinder engine, FIG. 2 is a plan view showing the V-2 cylinder engine of FIG. 1, FIG. 3 is an enlarged sectional view taken along a line III-III of a front cylinder 1 of FIG. 2 when viewed from the left side, FIG. 4 is a partial cut out sectional view (bottom view of a cylinder head 5) taken along a line IV-IV of FIG. 3, FIG. 5 is a sectional view (top view of a cylinder body 4) taken along FIG. 6 is a sectioned view taken along a line VI-VI of FIG. 4, and FIG. 7 is an enlarged longitudinal sectional view of a secondary air on-off valve 44. FIG. 8 is a bottom view of an air cleaner. For the sake of explanation, an axial direction of a crankshaft of the engine is set to a right and left direction of the engine, a direction perpendicular to the axial direction is set to a forward and rearward direction.

[Entire Structure of Engine]

Referring to FIG. 1, a front cylinder 1 bent forward and a rear cylinder 2 bent rearward are fastened to an upper end of a forward portion of a crank case 3. Both cylinders 1, 2 are arranged in V-shape when viewed from a lateral direction. Each of the cylinders 1 and 2 includes cylinder bodies 4 and 14 coupled to the upper end portion of the crank case 3 with bolts, cylinder heads 5 and 15 fastened to the upper ends of the cylinder bodies 4 and 14 with cylinder fastening bolts, and head covers 6 and 16 and the like coupled to the upper end of the cylinder heads 5 and 15 with bolts, respectively. Intake air inlets 8 and 18 are formed in a rear wall surface 5*b* of the cylinder head 5 of the front cylinder 1 and a front wall surface 15*a* of the cylinder head 15 of the rear cylinder 2 respectively. Intake air outlets of front and rear throttle devices 21 and 22 are connected to the intake air inlets 8 and 18 of the cylinders head 5 and 15 respectively. Intake air inlets of the throttle devices 21 and 22 are connected to front and rear cleaner outlets 25 and 26 in a bottom wall of an air cleaner 24 disposed above the throttle devices 21 and 22, respectively. The air cleaner 24 takes outside fresh air to supply into the throttle devices 21 and 22. Each of the throttle devices 21 and 22 includes a throttle body with a throttle valve. Each of the throttle devices 21 and 22 takes the intake air from the air cleaner 24 to mix fuel therein, and supplies the mixed intake air to each of the cylinder bores. In the present invention, the throttle devices 21 and 22 are not limited to above construction, a carburetor may be used as the throttle device.

Exhaust gas outlets 9 and 19 are formed in a front wall surface 5*a* (a first side surface) of the cylinder head 5 of the front cylinder 1 and a rear wall surface 15*b* (a first side surface) of the cylinder head 15 of the rear cylinder 2 respectively. Exhaust gas pipes 31 and 32 are connected to the exhaust gas outlets 9 and 19 respectively, and the exhaust gas pipes 31 and 32 are extended rearward and connected to an exhaust muffler (not shown).

Referring to FIG. 3, a matching surface 5*f* located at the lower end of the cylinder head 5 is overlapped with a matching surface 4*f* located at the upper end of the cylinder 4, and the cylinder head 5 is fastened to the cylinder 4 with the bolts as described above.

Referring to FIG. 4, an exhaust gas passage 20 formed in the cylinder head 5 of the front cylinder 1 is extended toward a cylinder center O1 from the exhaust gas outlet 9 formed in the front lower wall surface 5*a* of the cylinder head 5, and the exhaust gas passage 20 is branched at a midpoint into right and left branch exhaust gas passages 20*a* and 20*a* by a partition 23. The branch exhaust gas passages 20*a* and 20*a* are extended toward a pair of exhaust ports 11 and 11 opened to a combustion chamber 28, and the branch exhaust gas passages 20*a* and 20*a* are communicated with the exhaust ports 11 and 11 respectively. Plural cooling water jackets 35 are formed around the combustion chamber 28 (around a bore). Although not shown, the exhaust gas passage of the rear cylinder 2 of FIG. 2 has the structure similar to the exhaust gas passage of the front cylinder 1 except that the fore-and-aft direction is reversely formed.

(Configuration of Secondary Air Supply Apparatus)

In this V-type engine, besides a first air supply apparatus constituted by a air cleaner 24, throttle devises 21,22 intake ports 8,18 and etc., a secondary air supply apparatus is provided to the engine. Referring to FIG. 1, similarly to the cleaner outlets 25 and 26 for the intake air, a secondary air outlet 40 communicated with a clean side space of the air cleaner 24 is formed in the bottom wall of the air cleaner 24, and a secondary air source pipe 41 extended substantially downward is connected to the secondary air outlet 40. A secondary air on-off valve 44 is disposed near a bottom of a V-bank space formed between the front and rear cylinders 1 and 2, and a lower end portion of the secondary air source pipe 41 is connected to a secondary air inlet 45 formed at an upper end of the secondary air on-off valve 44.

In FIG. 8, a region S shown by a broken line is a region of the clean side space in the air cleaner 24 when viewed from above, and the secondary air on-off valve 44 is disposed in the region S and at the substantially same position as the secondary air outlet 40 when viewed from above as shown by a phantom line. That is, the secondary air on-off valve 44 is disposed substantially directly below the secondary air outlet 40 formed in the region S of the clean side space. The clean side space is an inside space of the cylindrical filter element disposed in the air cleaner 24.

Referring to FIG. 2, the secondary air on-off valve 44 is disposed near a right end portion of the bottom of the V-bank space, a secondary air outlet 48 for supplying the second air into the front cylinder 1 is formed at the end on the right side of the secondary air on-off valve 44, a secondary air outlet 49 for supplying the second air into the rear cylinder 2 is formed at the end on the left side of the secondary air on-off valve 44, and a secondary air pipe 51 for supplying the second air into the front cylinder 1 and a secondary air pipe 52 for supplying the second air into the rear cylinder 2 are connected to the secondary air outlets 48 and 49 respectively. The secondary air pipe 51 for supplying the second air into the front cylinder 1 is extended along a right side face of the front cylinder 1, and the secondary air pipe 51 is connected to an inlet 54*a* of the lead valve 54 for the front cylinder 1 attached to a right sidewall surface 5*c* of the cylinder head 5 of the front cylinder 1. On the other hand, the secondary air pipe 52 transverses leftward the bottom of the V-bank space, and is extended rearward along a left side face of the rear cylinder 2, and the secondary air pipe 52 is connected to an inlet 55*a* of a lead valve 55 for the rear cylinder 2 attached to a left sidewall surface 15*d* of the cylinder head 15 of the rear cylinder 2. A negative-pressure supply pipe 56 is connected to a lower end of the secondary air on-off valve 44, the negative-pressure supply pipe 56 is extended toward the intake air inlet 18 of the rear cylinder 2, and is connected to an intake-air negative-pressure generation portion in the intake air inlet 18.

Referring to FIG. 4, a secondary air entrance portion (chamber) 66 is formed in a front end portion of a right sidewall surface (a second side surface) 5*c* of the cylinder head 5 of the front cylinder 1, and the lead valve 54 for the front cylinder is attached to the position corresponding to the secondary air entrance portion 66 with the bolts. The lead valve 54 for the front cylinder includes a valve case 60, a valve support 62 having a valve hole 61, a flexible thin-plate valve body (lead) 63 made of stainless steel or a resin, and a guide 64 which regulates the maximum opening of the valve body 63. The valve body 63 is disposed such that the valve hole 61 is covered therewith from the left side. A rear end portion of the valve body 63 is fixed to the valve support 62 with a screw 67. The valve body 63 is pressed and opened leftward by a difference in pressure between the inside of the valve case 60 and the secondary air entrance portion 66 (pressure inside the valve case) pressure in the secondary air chamber), which causes the secondary air to flow only from the inside of the valve case 60 into the secondary air entrance portion 66. The rear end portion of the guide 64 is fixed to the valve support 62 along with the valve body 63, the guide 64 is inclined toward a left forward direction with respect to the valve support 62 to restrict the opening of the valve body 63 within a predetermined opening.

In the cylinder head 5 of the front cylinder 1, a secondary air passage 70 is formed from the secondary air entrance portion 66 to the right and left branch exhaust gas passages 20*a* and 20*a*. The secondary air passage 70 includes a first passage portion 71, a second passage portion 72, a third passage portion 73, and a fourth passage portion 74. As shown in FIG. 6, the first passage portion 71 is linearly extended toward the left downward direction from the secondary air entrance portion 66, and reaches a matching surface 5*f* at the lower end of the cylinder head 5. The second passage portion 72 is extended leftward from the left end portion of the first passage portion 71 to the region in the neighborhood below the exhaust gas passage 20. As shown in FIG. 3, the third passage portion 73 is extended toward the rear upward direction from the left end portion of the second passage portion 72 to the inside of the partition 23. The fourth passage portion 74 is branched into right and left from the rear upper end portion of the third passage portion 73, and is opened to the side face of each branch exhaust gas passage 20*a*.

Referring to FIG. 6, the second passage portion 72 of the secondary air passage 70 includes a groove formed in the matching surface 5*f* located at the lower end of the cylinder head 5, and the second passage portion 72 is molded during the casting or die-casting of the cylinder head 5. On the other hand, the first passage portion 71 is formed in a so-called drill hole which is made using the drill after the casting or die-casting of the cylinder head 5. Referring to FIG. 3, the third passage portion 73 is a so-called drill hole which is made using the drill after the casting of the cylinder head 5 like the first passage portion 71. The fourth passage portion 74 is molded during the casting of the cylinder head 5.

Referring to FIG. 5, in this embodiment, the cooling water jacket 36 is opened on the matching surface 4*f* located at the upper end of the cylinder 4, whereas a passage portion for secondary air is not formed.

Although not shown, the secondary air passage having the structure similar to that of the front cylinder 1 is formed in the cylinder head 15 of the rear cylinder 2 of FIG. 1. However, in the secondary air passage of the rear cylinder 2, the right and left and the front and rear are inversely formed compared with the secondary air passage of the front cylinder 1.

(Secondary Air on-Off Valve)

Referring to FIG. 7, usually the secondary air on-off valve 44 is referred to as air cut valve, a secondary air inlet 45 formed at the upper end of the secondary air on-off valve 44 is formed in a cylindrical shape projected upward, a negative-pressure inlet port 59 formed at the lower end of the secondary air on-off valve 44 is formed in a cylindrical shape projected leftward, the secondary air outlet 48 for the front cylinder 1 formed at the right end of the secondary air on-off valve 44 is formed in a cylindrical shape projected rightward, and the secondary air outlet 49 for the rear cylinder 2 formed at the left end of the secondary air on-off valve 44 is formed in a cylindrical shape projected leftward. A valve chamber 82 is formed in an upper portion of a valve case 80, and a negative-pressure actuating chamber 83 is formed in a lower portion of the valve case 80. The valve chamber 82 is communicated with the secondary air inlet 45 while accommodating a valve body 81. The negative-pressure actuating chamber 83 is communicated with the negative-pressure inlet port 59. The valve chamber 82 is communicated with the right and left secondary air outlets 49 and 48 through the valve hole 84, and the valve chamber 82 includes a valve seat 85. The valve body 81 is seated on the valve seat 85 to cut off between the valve chamber 82 and both the secondary air outlets 48 and 49, thereby closing the secondary air on-off valve 44. An upper side of the negative-pressure actuating chamber 83 is covered with a flexible rubber diaphragm 86, and the diaphragm 86 is biased upward by a valve spring 89 while fixed to a lower end portion of a connecting rod 87 by a pair of clamping plates 88. The connecting rod 87 is extended upward, and the valve body 81 is fixed to the upper end portion of the connecting rod 87. That is, when the negative pressure is not supplied to the negative-pressure actuating chamber 83 or when the negative pressure is lowered, the diaphragm 86 and the valve body 81 is moved upward by the valve spring 89 to keep the valve hole 84 opened. On the contrary, when at least a predetermined amount or more of negative pressure is supplied to the negative-pressure actuating chamber 83, the negative pressure bends downward the diaphragm 86 against the valve spring 89, which lowers the valve body 81 against the connecting rod 87 to close the valve hole 84. As mentioned above, the secondary air source pipe 41 is linearly extended in a substantially perpendicular direction, the secondary air on-off valve 44 is fixed to the bottom portion of the V-bank space, and a part of the secondary air pipe 41 is extended near the bottom portion of the V-bank space in an substantially orthogonal direction to a sidewall face in the outer peripheral wall surface of the cylinder bore. The secondary air on-off valve 44 is fixed to the extended part of the secondary air pipe 41. The secondary air on-off valve 44 including a structure shown in FIG. 7 is an example, the present invention includes various alternative valves.

(Secondary Air Flow)

(1) Referring to FIGS. 1 and 2, when the negative pressure of the negative-pressure generating portion of the intake air inlet 18 of the cylinder head 15 is zero or lower than a predetermined value like the case in which the engine is stopped or idled, the secondary air on-off valve 44 is opened as shown in FIG. 7. Accordingly, part of the air in the clean side space of the air cleaner 24 passes through the secondary air on-off valve 44 from the secondary air source pipe 41, and the part of the air is distributed as the secondary air to the right and left secondary air supply pipes 52 and 51. The secondary air distributed to the secondary air supply pipe 51 for the front cylinder is supplied to the lead valve 54 for the front cylinder, and the secondary air distributed to the secondary air supply pipe 52 for the rear cylinder is supplied to the lead valve 55 of the rear cylinder 2.

(2) Referring to FIG. 4, the secondary air supplied to the valve case 60 of the lead valve 54 for the front cylinder presses and opens the valve body 63 to flow into the secondary air entrance portion 66, the secondary air flows leftward through the first and second passage portions 71 and 72 of the secondary air passage 70 to reach an under-position of the exhaust gas passage 20. Then, the secondary air flows in the third passage portion 73 from the left end portion of the second passage portion 72 toward the rear upward direction, enters the partition 23 of the branch exhaust gas passages 20*a* and 20*a* to reach the neighborhood of the downstream end portion of the exhaust gas, i.e., the neighborhood of the exhaust port 11. Then, the secondary air is branched into right and left in the fourth passage portion 74, and is supplied to the right and left branch exhaust gas passages 20*a* and 20*a* and used to re-burn the unburned gas.

In the rear cylinder 2 of FIG. 1, basically similarly to the front cylinder 1, the secondary air is supplied to the neighborhood in the downstream end portion of the exhaust gas of the right and left branch exhaust gas passages through the secondary air passage.

When the throttle devices 21 and 22 are closed while the engine runs in a high revolving speed range, because the intake air negative pressure is increased, the secondary air on-off valve 44 is closed (air cut off state). When the revolving speed of the engine is decreased, the intake air negative pressure is lowered to open the secondary air on-off valve (air flowing state).

Effect of Embodiment

According to the embodiment, in the V-type engine in which the air cleaner 24 is disposed above the throttle devices 21 and 22 while the throttle devices 21 and 22 are disposed between the front and rear cylinders 1 and 2, the secondary air on-off valve 44 is disposed below the throttle devices 21 and 22, and the secondary air on-off valve 45 is provided so as to be substantially accommodated in the V-bank space between the cylinders 1 and 2, the secondary air inlet 45 of the secondary air on-off valve 44 is connected to the secondary air outlet portion 40 in the bottom wall of the air cleaner 24 by the secondary air source pipe 41 extended-upward from the secondary air on-off valve 44, and the secondary air pipes 51 and 52 for cylinders 1 and 2 are connected to the secondary air outlets 48 and 49 of the secondary air on-off valve 44 for cylinders 1 and 2 respectively. Therefore, the secondary air on-off valve 44 and the secondary air pipes 51 and 52 can be disposed below the cylinders to keep the total height of the engine at a lower level, the compact external piping for secondary air including the secondary air source pipe 41, the secondary air pipes 51 and 52, and the secondary air on-off valve 44 can be disposed around the engine main body, and the periphery of the whole engine can be downsized.

In the outer peripheral wall surface of each of the cylinders 1 and 2, since the secondary air entrance portion 66 and the lead valves 54 and 55 are disposed on the sidewall surfaces 5*c* and 15*d* which are substantially orthogonal to the front-side wall surfaces 5*a* and 15*a* or rear-side wall surfaces 5*b* and 15*b*, the distance between the secondary air on-off valve 44 disposed in the V-bank space and the secondary air entrance portion 66 and the lead valves 54 and 55 is shortened, so that the secondary air pipes 51 and 52 can be shortened to further downsize the piping for secondary air.

In FIG. 8, since the secondary air on-off valve 44 is substantially positioned in the region S of the clean side space of the air cleaner 24 when viewed from above, the secondary air outlet portion 40 of the air cleaner 24 and the secondary air inlet 45 (see FIG. 2) of the secondary air on-off valve 44 can be connected by the most direct way using the short secondary air source pipe 41. Additionally, as shown in FIG. 7, since the secondary air inlet 45 of the secondary air on-off valve 44 is formed in the upper end face of the secondary air on-off valve 44 while projected upward in the cylindrical shape, the secondary air source pipe 41 can linearly be disposed while vertically extended, which facilitates the assembling work of the secondary air source pipe 41.

In the outer peripheral wall surface of each of the cylinders 1 and 2, since the lead valves 54 and 55 are disposed in the sidewall surfaces 5*c* and 15*d* which is substantially orthogonal to the front-side wall surfaces 5*a* and 15*a* or rear-side wall surfaces 5*b* and 15*b*, the fore-and-aft length of the engine can be shortened, and the lead valves 54 and 55 can easily be detached from the side of right and left wheels.

In the secondary air on-off valve 44, since the secondary air inlet 45 is provided at the upper end, the negative-pressure inlet port 59 for start-up is provided in the lower end portion, and the pair of secondary air outlets 48 and 49 is provided on the right and left side end portions, the secondary air source pipe 41, the pair of secondary air pipes 51 and 52 and the negative-pressure supply pipe 56 can be connected to the secondary air inlet 45, the negative-pressure inlet port 59, and the secondary air outlets 48 and 49 without interfering with one another respectively, and the piping structure for secondary air can be simplified.

Other Embodiments (1) The lead valve 54 for the front cylinder and the lead valve 55 for the rear cylinder may horizontally be disposed together on the same side. In this case, for example, the secondary air on-off valve 44 is disposed nearer the right, and the lead valves 54 and 55 are disposed in the right side face. Therefore, the pipe lengths of the secondary air pipes 51 and 52 can further be shortened; the lengths of the secondary air pipes 51 and 52 can be equalized, the amounts and pressures of secondary air supplied to the cylinders 1 and 2 can be uniformed.

(2) In above the embodiment, the air cleaner 24 is disposed in the upper portion of the V-bank space. The invention is not limited to the structure of the embodiment, but the invention can be applied to the engine in which the air cleaner 24 is disposed on the right or left side of each cylinder.

(3) The invention is not limited to the configuration described in the embodiments, but various modifications can be made without departing from the scope of the invention.

What is claimed is:

1. A V-type engine including front and rear cylinders disposed in a V-shape, a throttle device disposed between the front and rear cylinders, an air cleaner disposed above the throttle device, and a secondary air supply apparatus, wherein the secondary air supply apparatus comprises:

a secondary air pipe connected to a secondary air entrance portion provided on an outer peripheral wall surface surrounding each cylinder bore;

a secondary air on-off valve disposed below the throttle device, the secondary air on-off valve being provided so as to be substantially accommodated in a V-bank space between the cylinders; and a secondary air source pipe extended upward from a secondary air inlet of the secondary air on-off valve and connected to the air cleaner, and a secondary air outlet for each cylinder is connected to the secondary air pipe for each cylinder, the secondary air outlet for each cylinder being formed in the secondary air on-off valve.

2. The V-type engine as claimed in claim 1, wherein the secondary air entrance portion is provided in a sidewall surface which is substantially orthogonal to a wall surface on a front side or a rear side in the outer peripheral wall surface of each cylinder bore.

3. The V-type engine as claimed in claim 2, wherein a lead valve for secondary air is provided in the secondary air entrance portion of each cylinder.

4. The V-type engine according to claim 1, wherein the secondary air on-off valve is substantially positioned in a region of a clean side space of the air cleaner when viewed from above.

5. The V-type engine according to claim 4, wherein the secondary air source pipe is linearly extended in a substantially perpendicular direction.

6. The V-type engine according to claim 1, wherein the secondary air on-off valve is fixed to a bottom portion of the V-bank space.

7. The V-type engine according to claim 1, wherein a part of the secondary air pipe is extended near the bottom portion of the V-bank space in an substantially orthogonal direction to a sidewall face in the outer peripheral wall surface of the cylinder bore, and the secondary air on-off valve is fixed to the extended part.

8. The V-type engine according to claim 2, wherein the secondary air on-off valve is disposed on a straight line connecting the secondary air inlets of the secondary air entrance portions of the cylinders when viewed from the side of the V-type engine.

9. The V-type engine according to claim 1, wherein the secondary air inlets of the secondary air entrance portions of the cylinders are disposed on a virtual plane including the secondary air on-off valve.

10. A V-type engine including front and rear cylinders disposed in a V-shape, an air cleaner arranged above the cylinders, and a secondary air supply apparatus, wherein the secondary air supply apparatus comprises:

a secondary air pipe connected to a secondary air entrance portion provided in an outer peripheral wall surface surrounding each cylinder bore;

a secondary air on-off valve disposed below top surfaces of the cylinders, the secondary air on-off valve being provided so as to be substantially accommodated in a V-bank space between the cylinders; and a secondary air source pipe extended from a secondary air inlet of the secondary air on-off valve and connected to the air cleaner, and a secondary air outlet for each cylinder is connected to the secondary air pipe for each cylinder, the secondary air outlet for each cylinder being formed in the secondary air on-off valve.

* * * * *